US011363691B2

(12) United States Patent
Shum et al.

(10) Patent No.: US 11,363,691 B2
(45) Date of Patent: Jun. 14, 2022

(54) DRIVER INCORPORATING A LIGHTING BALLAST FOR SUPPLYING CONSTANT VOLTAGE LOADS

(71) Applicant: Filament Lighting, LLC, Sunnyvale, CA (US)

(72) Inventors: Frank Shum, Sunnyvale, CA (US); Ray Orr, Calgary (CA)

(73) Assignee: Filament Lighting, LLC, Sunnyvale, CA (US)

( * ) Notice: Subject to any disclaimer, the term of this patent is extended or adjusted under 35 U.S.C. 154(b) by 0 days.

(21) Appl. No.: 17/179,843

(22) Filed: Feb. 19, 2021

(65) Prior Publication Data

US 2021/0267033 A1 Aug. 26, 2021

Related U.S. Application Data

(60) Provisional application No. 62/979,254, filed on Feb. 20, 2020.

(51) Int. Cl.
*H05B 45/34* (2020.01)
*H05B 45/37* (2020.01)
*H05B 45/40* (2020.01)

(52) U.S. Cl.
CPC ..... *H05B 45/34* (2020.01); *H05B 45/37* (2020.01); *H05B 45/40* (2020.01)

(58) Field of Classification Search
None
See application file for complete search history.

(56) References Cited

U.S. PATENT DOCUMENTS

2011/0121756 A1* 5/2011 Thomas ..... H05B 45/3725 315/294
2014/0159592 A1* 6/2014 Pan ..... H05B 45/00 315/187
2018/0116030 A1* 4/2018 Sam ..... H05B 45/48
2019/0191526 A1* 6/2019 Wang ..... H01H 37/76

* cited by examiner

*Primary Examiner* — Jany Richardson
(74) *Attorney, Agent, or Firm* — Craige Thompson; Thompson Patent Law; Timothy D. Snowden

(57) ABSTRACT

Apparatus and associated methods relate to powering a constant voltage DC load using a rectified output of a lighting ballast. In an illustrative example, the ballast may be configured to operate as a constant-current source. The DC load may, for example, comprise an array of LED strings connected in parallel. The number of LED strings may, for example, be selected to match a power output of the ballast. The number of LEDs in each string may, for example, be selected to match a rectified voltage output range of the ballast. A normally-open thermostat may, for example, be connected in parallel between the ballast and a rectifier and be configured to short-circuit the ballast if the circuit overheats. Various embodiments may advantageously utilize existing power processing functions of an electronic ballast to reduce complexity of a driver circuit for a constant voltage DC source.

19 Claims, 3 Drawing Sheets

DRIVER INCORPORATING A LIGHTING BALLAST FOR SUPPLYING CONSTANT VOLTAGE LOADS

CROSS-REFERENCE TO RELATED APPLICATIONS

This application claims the benefit of U.S. Provisional Application Ser. No. 62/979,254, titled "DRIVER INCORPORATING A LIGHTING BALLAST FOR SUPPLYING CONSTANT VOLTAGE LOADS," filed by Frank Shum and Ray Orr, on Feb. 20, 2020.

This application incorporates the entire contents of the foregoing application(s) herein by reference.

TECHNICAL FIELD

Various embodiments relate generally to lighting systems.

BACKGROUND

High-intensity discharge lamps (HID lamps) are a type of electrical gas-discharge lamp which produces light by means of an electric arc between tungsten electrodes housed inside a translucent or transparent fused quartz or fused alumina arc tube. This tube is filled with noble gas and often also contains suitable metal or metal salts. The noble gas enables the arc's initial strike. Once the arc is started, it heats and evaporates the metallic admixture. Its presence in the arc plasma greatly increases the intensity of visible light produced by the arc for a given power input, as the metals have many emission spectral lines in the visible part of the spectrum. High-intensity discharge lamps are a type of arc lamp.

SUMMARY

Apparatus and associated methods relate to powering a constant voltage DC load using a rectified output of a lighting ballast. In an illustrative example, the ballast may be configured to operate as a constant-current source. The DC load may, for example, comprise an array of LED strings connected in parallel. The number of LED strings may, for example, be selected to match a power output of the ballast. The number of LEDs in each string may, for example, be selected to match a rectified voltage output range of the ballast. A normally-open thermostat may, for example, be connected in parallel between the ballast and a rectifier and be configured to short-circuit the ballast if the circuit overheats. Various embodiments may advantageously utilize existing power processing functions of an electronic ballast to reduce complexity of a driver circuit for a constant voltage DC source.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
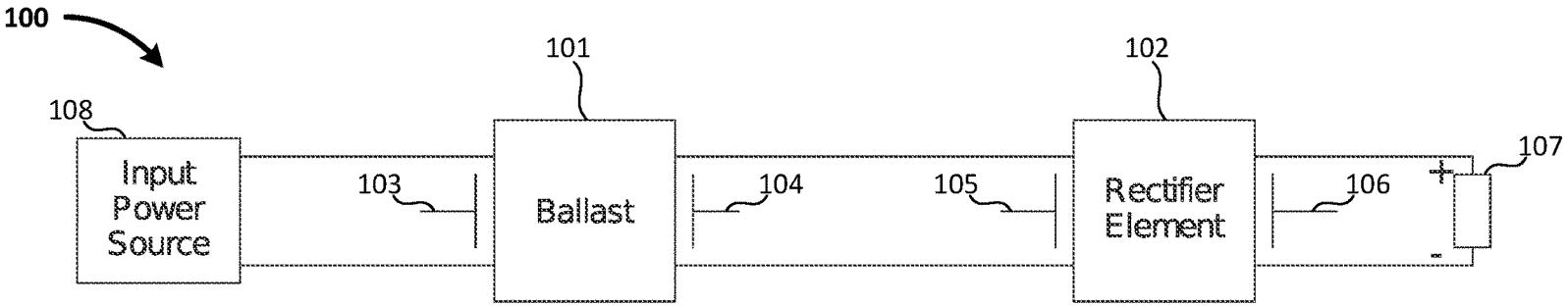
FIG. 1 is a block diagram of an exemplary LED driver and ballast method.

FIG. 1 is a block diagram of an exemplary LED driver and ballast method. A system 100 includes a ballast 101. The ballast 101 includes an input 103 and an output 104. The input 103 is operably coupled to a ballast input power source 108. The output is operably coupled to an input 105 of a rectifier element 102. An output 106 of the rectifier element 102 is operably coupled to a LED lamp 107. The connections between 101 and 102 may facilitate impedance matching. The ballast 101 may operate using constant current. The system 100 may function as a driver that plugs into another driver to drive the LED lamp 107.

In various embodiments the ballast 101 may, for example, be a circuit which behaves as a constant power source. For example, the ballast 101 may behave as a constant current source over an operating voltage range. The ballast 101 may, for example, be an electronic ballast. In some embodiments the electronic ballast may, for example, be a non-magnetic ballast. For example, the ballast 101 may change a frequency of alternating current (AC) power supplied by the ballast input power source 108 without any (substantial) change in a voltage of the AC power. The ballast 101 may, for example, increase a frequency of the AC power significantly above an input frequency (e.g., about 60 Hz). The frequency may, by way of example and not limitation, be increased by one or more orders of magnitude (e.g., to about 20 kHz). In various embodiments the ballast 101 may, by way of example and not limitation, include multiple inductance coils. In various embodiments the ballast 101 may, for example, be designed to power a high-intensity discharge (HID) lamp. For example, the ballast 101 may be configured to provide a constant power supply (e.g., constant current).

Figure 2:
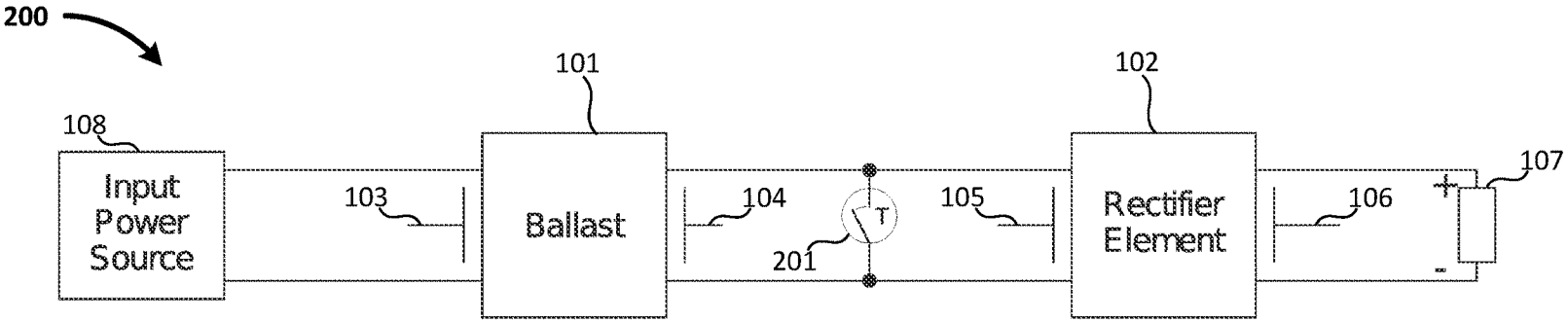
FIG. 2 is a block diagram of an exemplary LED driver and ballast method incorporating thermal protection.

FIG. 2 is a block diagram of an exemplary LED driver and ballast method incorporating thermal protection. The system 200 may be substantially similar to the system 100, but with the addition of a thermostat 201 coupled between the ballast output 104 and the rectifier element 102. The thermostat 201 may, for example, be configured to close at a predetermined temperature. Accordingly, the thermostat 201 may advantageously be configured to short out the circuit when the system 200 overheats. In various embodiments the connection of the thermostat 201 in parallel may advantageously avoid a back electromagnetic field (EMF) voltage spike associated with opening a circuit having one or more inductors.

Figure 3:
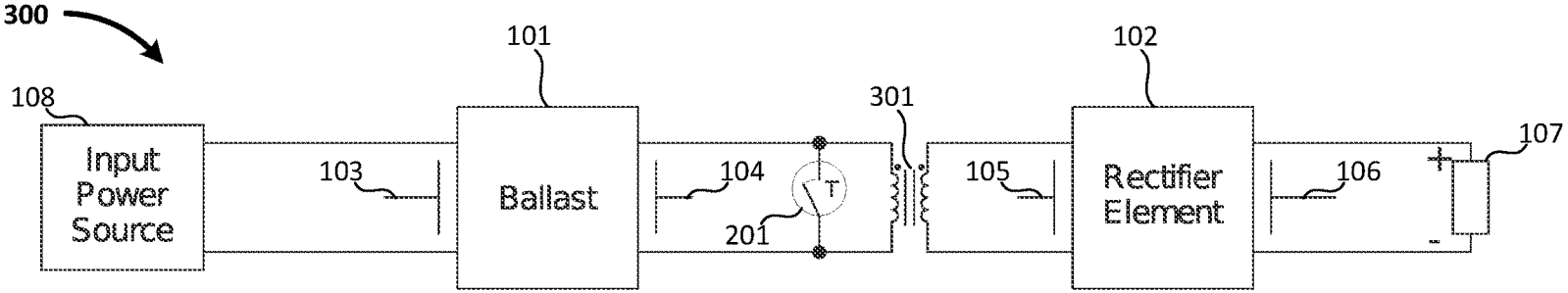
FIG. 3 is a block diagram of an exemplary LED driver and ballast method.

FIG. 3 is a block diagram of an exemplary LED driver and ballast method. The system 300 may be substantially similar to the system 200, but with the addition of a transformer 301 coupled between the ballast output 104 and the rectifier element 102. The transformer 301 may, for example, be configured to adjust voltage of power received from the ballast 101 before the rectifier 102. For example, the transformer 301 may alter a voltage of the power received from the ballast 101 up and/or down as necessary to be within a predetermined voltage range for the rectifier element 102.

Figure 4:
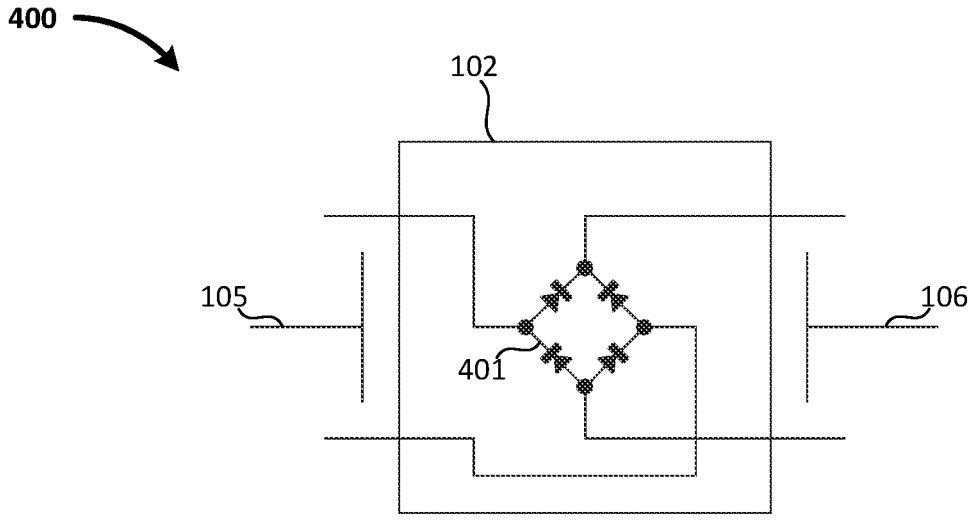
FIG. 4 is an electrical schematic of an exemplary rectifier element.

FIG. 4 is an electrical schematic of an exemplary rectifier element. The rectifier element 400 may include a diode bridge circuit 401 that is operably coupled to the input 105 and the output 106.

Figure 5:
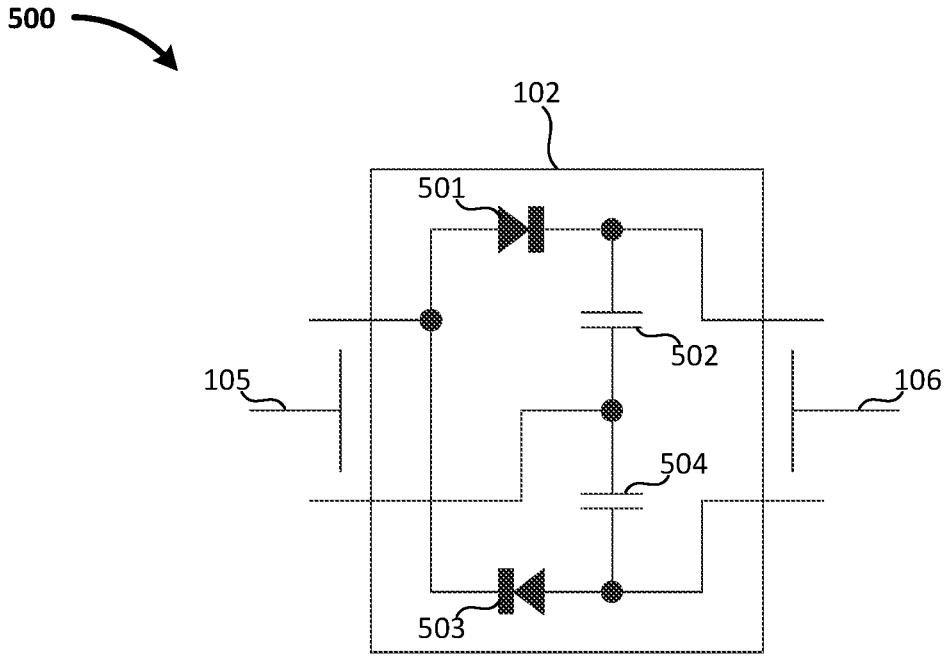
FIG. 5 is an electrical schematic of an exemplary rectifier element.

FIG. 5 is an electrical schematic of an exemplary rectifier element. The rectifier element 500 includes two diodes 501, 503, along with two capacitors 502, 504 that are operably coupled to the input 105 and the output 106.

Figure 6:
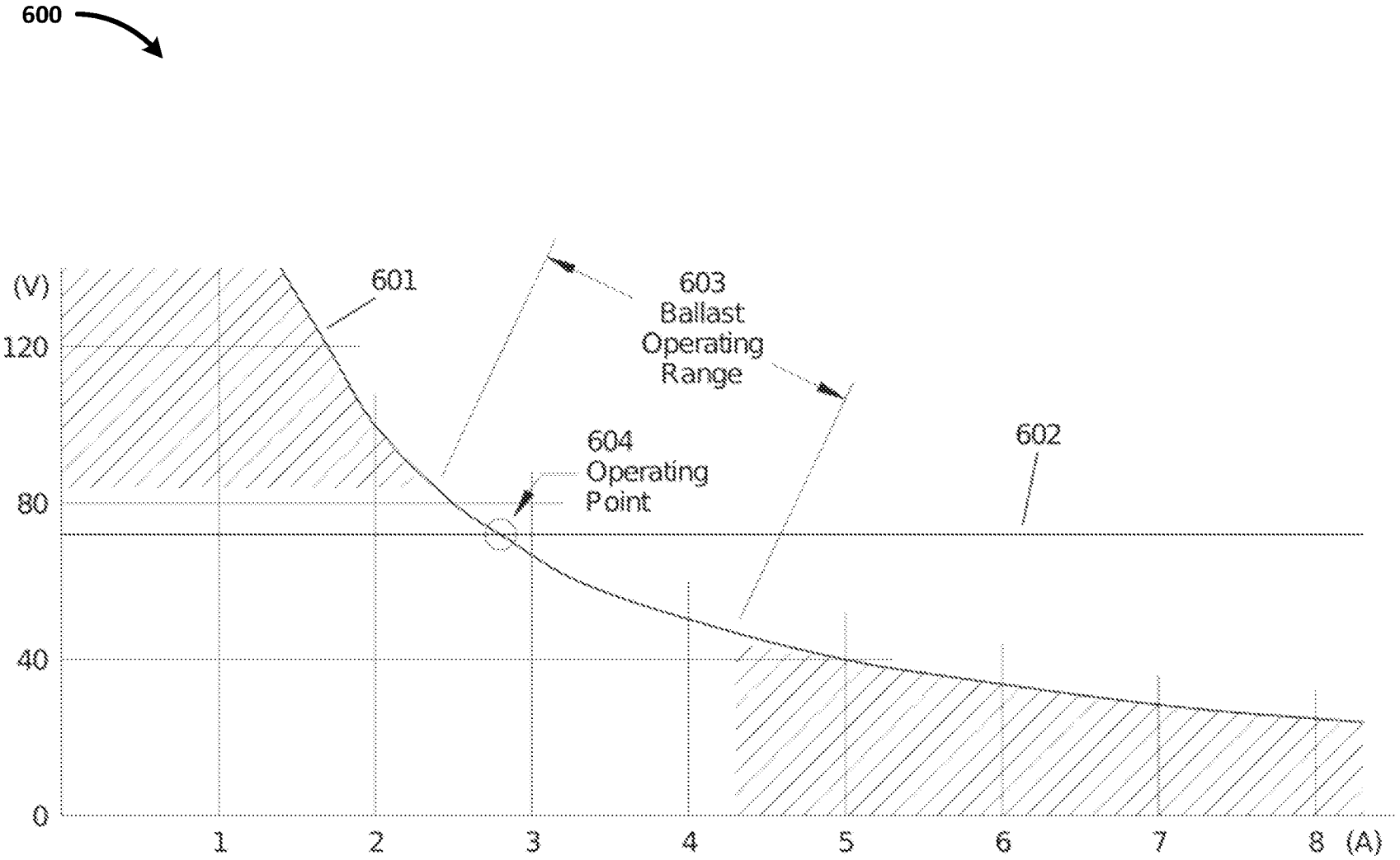
FIG. 6 is a graph depicting an exemplary intersection of the plots of the rectified ballast output voltage versus current and the load input voltage versus current.

FIG. 6 is a graph 600 depicting an exemplary intersection of the plots of the rectified ballast output voltage versus current and the load input voltage versus current. Many ballasts for HID lamps behave as constant power sources (601) or constant current sources over an operating voltage. This phenomenon is illustrated in the amps vs. voltage graph of FIG. 6. By arranging a number (e.g., N) LEDs in a series combination to achieve an operating voltage in the middle of the of the rectified output voltage range of the ballast, and arranging sufficient parallel strings (e.g., M) of LEDs to match the power of the ballast, the system can engage the ballast's regulation characteristics to control the power in the LED array. The operating point of the system may be at the intersection (604) of the load curve of the LED array (M strings of N LEDs) and the power curve of the ballast. In various embodiments constant voltage loads that can be powered this way include, by way of example and not limitation, diodes, batteries, or some combination thereof.

Although various embodiments have been described with reference to the Figures, other embodiments are possible. For example, an apparatus for powering constant voltage DC loads from a lighting ballast may include a ballast, a rectifier element, and one or more substantially constant voltage DC loads. In various embodiments, the input terminals of the ballast may be coupled to a power source. The output terminals of the ballast may, for example, be coupled to the AC terminals of a rectifier element. The DC terminals of the rectifier element may, for example, be coupled to the terminals of the substantially constant voltage DC load.

An apparatus for powering constant voltage DC loads from a lighting ballast may include a ballast, a rectifier element, one or more substantially constant voltage DC loads, and a thermostat. In some illustrative embodiments, the input terminals of the ballast may be coupled to a power source, the output terminals of the ballast may be coupled to the AC terminals of a rectifier element, the DC terminals of the rectifier element may be coupled to the terminals of the substantially constant voltage DC load, and/or the terminals of the thermostat may be coupled to the output terminals of the ballast. The ballast may be an electronic ballast. The rectifier element may be a diode bridge. The one or more substantially constant voltage DC loads may include multiple LEDs. The thermostat may be a normally open bi-metal thermostat.

An LED lighting method may include, in an exemplary aspect, rectifying the output power of a lighting ballast to produce a substantially DC output. The method may include determining the operational power and rectified voltage range of the ballast. The method may include choosing an array of LEDs to match the power of the ballast. The method may include arranging the series and parallel connections of the LEDs such that the applied voltage when operating at the ballast power is near the midpoint of the ballast rectified voltage range. The method may include supplying power from the ballast via a rectifying element to the series and parallel arrangement of LEDs.

Creating LED lamps that are installed in the same way as a bulb replacement may be highly advantageous to reduce the cost of retrofit installation in existing light fixtures. In the case of discharge lamps, the ballast that is used to control the power in the discharge bulb may be incorporated into the fixture. LED lamps designed for installation in these fixtures may accept the power and waveforms that are generated by the ballast in order to function in these applications. An optimal solution disclosed herein is to utilize the existing power processing functions of the ballast to reduce the complexity of the driver electronics in the LED lamp.

Temporary auxiliary energy inputs may be received, for example, from chargeable or single use batteries, which may enable use in portable or remote applications. Some embodiments may operate with other DC voltage sources, such as batteries, for example. Alternating current (AC) inputs, which may be provided, for example from a 50/60 Hz power port, or from a portable electric generator, may be received via a rectifier and appropriate scaling. Provision for AC (e.g., sine wave, square wave, triangular wave) inputs may include a line frequency transformer to provide voltage step-up, voltage step-down, and/or isolation.

Various examples of modules may be implemented using circuitry, including various electronic hardware. By way of example and not limitation, the hardware may include transistors, resistors, capacitors, switches, integrated circuits, other modules, or some combination thereof. In various examples, the modules may include analog logic, digital logic, discrete components, traces and/or memory circuits fabricated on a silicon substrate including various integrated circuits (e.g., FPGAs, ASICs), or some combination thereof. In some embodiments, the module(s) may involve execution of preprogrammed instructions, software executed by a processor, or some combination thereof. For example, various modules may involve both hardware and software.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

The invention claimed is:

1. An impedance-matched circuit for powering constant voltage direct-current (DC) loads from a lighting ballast, the circuit comprising:

a non-magnetic electronic ballast configured to power a high-intensity discharge lamp and configured to generate a power supply with a substantially constant current from an alternating current (AC) power source;

a rectifier element operably coupled to the ballast to transform the substantially constant power supply to a substantially DC power output;

at least one DC load having substantially constant voltage draw and operably coupled to the rectifier element to be powered by the DC power output; and, a thermostat operably coupled in parallel between the ballast and the rectifier element and configured to short-circuit the ballast when a detected temperature exceeds a predetermined temperature threshold.

2. The circuit of claim 1, wherein the rectifier element comprises a diode bridge.

3. The circuit of claim 2, wherein the rectifier element further comprises a first capacitor connected to an input of the rectifier element and a second capacitor coupled to an output of the rectifier element.

4. The circuit of claim 1, wherein the DC load comprises a plurality of light emitting diodes (LEDs).

5. The circuit of claim 4, wherein the DC load comprises a quantity of DC load components, wherein the quantity is selected such that an operating voltage of the DC load is within a rectified output voltage range of the ballast.

6. The circuit of claim 5, wherein:

the DC load comprises M DC load components connected in parallel, at least one of the M DC load components comprises N DC load subcomponents connected in series, N is selected such that an operating voltage of the DC load is within a rectified output voltage range of the ballast, and M is selected such than an operating power of the DC load is within a power output range of the ballast.

7. An impedance-matched circuit for powering constant voltage direct-current (DC) loads from a lighting ballast, the circuit comprising:

a ballast configured to generate a substantially constant power supply from an alternating current (AC) power source;

a rectifier element operably coupled to the ballast to transform the substantially constant power supply to a substantially DC power output; and, at least one DC load having substantially constant voltage draw and operably coupled to the rectifier element to be powered by the DC power output, wherein the rectifier element further comprises a first capacitor connected to an input of the rectifier element and a second capacitor coupled to an output of the rectifier element.

8. The circuit of claim 7, wherein the ballast is a non-magnetic electronic ballast.

9. The circuit of claim 8, wherein the ballast is configured to power a high-intensity discharge lamp.

10. The circuit of claim 8, wherein the ballast is configured to generate the substantially constant power supply with a substantially constant current.

11. The circuit of claim 7, wherein the rectifier element comprises a diode bridge.

12. The circuit of claim 7, wherein the DC load comprises a light emitting diode (LED).

13. The circuit of claim 7, wherein the DC load comprises a plurality of light emitting diodes (LEDs).

14. The circuit of claim 13, wherein the DC load comprises a quantity of DC load components, wherein the quantity is selected such that an operating voltage of the DC load is within a rectified output voltage range of the ballast.

15. The circuit of claim 13, wherein:

the DC load comprises M DC load components connected in parallel, at least one of the M DC load components comprises N DC load subcomponents connected in series, N is selected such that an operating voltage of the DC load is within a rectified output voltage range of the ballast, and M is selected such than an operating power of the DC load is within a power output range of the ballast.

16. The circuit of claim 7, further comprising:

a thermostat operably coupled in parallel between the ballast and the rectifier element and configured to short-circuit the ballast when a temperature of the circuit exceeds a predetermined temperature threshold.

17. The circuit of claim 16, wherein the thermostat comprises a normally-open bi-metal thermostat.

18. A method of powering a constant-voltage load with a high-intensity discharge ballast, the method comprising:

providing a rectifying element configured to generate a substantially DC power output from a substantially constant current output of an electronic ballast, the constant current output being generated by the ballast from an alternating current (AC) power source;

providing at least one DC load having substantially constant voltage draw and operably coupled to be powered by the DC power output; and, providing a thermostat operably coupled in parallel between the ballast and the rectifying element and configured to disable a current flow from the ballast to the at least one DC load when a detected temperature exceeds a predetermined temperature threshold.

19. The method of claim 18, further comprising:

determining a power output range and rectified output voltage range of the ballast;

configured the DC load as an array of M DC load components connected in parallel;

configuring at least one of the M DC load components as an array of N DC load subcomponents connected in series;

selecting N such that an operating voltage of the DC load is within the rectified output voltage range of the ballast, and selecting M such than an operating power of the DC load is within the power output range of the ballast.

* * * * *